US010879632B2

(12) United States Patent
Jakobs et al.

(10) Patent No.: US 10,879,632 B2
(45) Date of Patent: Dec. 29, 2020

(54) POSITIONING ELEMENT AND CONTACTING ELEMENT FOR TWIN AXIAL CABLES

(71) Applicant: LEONI KABEL GMBH, Nuremberg (DE)

(72) Inventors: Frank Jakobs, Ostrhauderfehn (DE); Nikolai Giske, Fiesoythe (DE); Alexander Franck, Oldenburg (DE)

(73) Assignee: Leoni Kabel GmbH, Roth (DE)

( * ) Notice: Subject to any disclaimer, the term of this patent is extended or adjusted under 35 U.S.C. 154(b) by 0 days.

(21) Appl. No.: 16/618,970

(22) PCT Filed: Jun. 6, 2018

(86) PCT No.: PCT/EP2018/064897
§ 371 (c)(1),
(2) Date: Dec. 3, 2019

(87) PCT Pub. No.: WO2018/228886
PCT Pub. Date: Dec. 20, 2018

(65) Prior Publication Data

US 2020/0144739 A1 May 7, 2020

(30) Foreign Application Priority Data

Jun. 12, 2017 (DE) ..... 10 2017 209 868

(51) Int. Cl.
*H01R 9/05* (2006.01)
*H01R 9/053* (2006.01)
(Continued)

(52) U.S. Cl.
CPC ..... *H01R 9/053* (2013.01); *H01R 4/24* (2013.01); *H01R 4/2406* (2018.01); *H01R 9/031* (2013.01);
(Continued)

(58) Field of Classification Search
CPC ..... H01R 9/053; H01R 4/2406; H01R 12/53; H01R 4/66; H01R 4/2445; H01R 9/031; H01R 4/24; H01F 2027/065
(Continued)

(56) References Cited

U.S. PATENT DOCUMENTS 2,107,835 A * 2/1938 Pierce ..... H01R 4/66 439/100
4,420,211 A * 12/1983 Ledbetter ..... H01R 12/616 439/408
(Continued)

FOREIGN PATENT DOCUMENTS

CN 101026268 A 8/2007
CN 103187636 A 7/2013
(Continued)

OTHER PUBLICATIONS

English Translation, Masayuki, WO2012/137547 (Year: 2012).*
(Continued)

*Primary Examiner* — Steven T Sawyer
(74) *Attorney, Agent, or Firm* — Williams Mullen; Thomas F. Bergert

(57) ABSTRACT

The invention relates to a positioning element for twin axial cables as well as to a contacting element comprising a positioning element of said type. In an illustrative embodiment of a positioning element for twin axial cables, the positioning element is at least partially electroconductive. Furthermore, the positioning element has at least one recess which is arranged and designed to accommodate a twin axial cable in such a way that an electroconductive connection is established between an outer conductor of the twin axial cable and the positioning element.

11 Claims, 7 Drawing Sheets

(51) Int. Cl.

| | |
|---|---|
| ***H01R 4/2406*** | (2018.01) |
| ***H01R 12/53*** | (2011.01) |
| ***H01R 13/6591*** | (2011.01) |
| ***H01R 4/24*** | (2018.01) |
| ***H01R 9/03*** | (2006.01) |

(52) U.S. Cl.
CPC ..... *H01R 12/53* (2013.01); *H01R 13/65914* (2020.08)

(58) Field of Classification Search
USPC ..... 439/98, 394; 174/40 CC
See application file for complete search history.

(56) References Cited

U.S. PATENT DOCUMENTS

| | | | | |
|---|---|---|---|---|
| 4,427,253 | A * | 1/1984 | Smith | H01R 4/2408 439/413 |
| 4,533,193 | A * | 8/1985 | Blackwood | H01R 9/053 29/838 |
| 5,076,800 | A | 12/1991 | Milnes et al. | |
| 6,155,847 | A * | 12/2000 | Wright | H01R 4/646 174/40 CC |
| 7,377,801 | B2 * | 5/2008 | Sakaguchi | H01R 4/2445 439/394 |
| 7,431,608 | B2 * | 10/2008 | Sakaguchi | H01R 4/2454 439/394 |
| 2002/0042216 | A1 * | 4/2002 | Kato | H01R 4/66 439/92 |
| 2007/0197097 | A1 * | 8/2007 | Sakaguchi | H01R 4/2454 439/607.41 |
| 2009/0101408 | A1 | 4/2009 | Koyarna et al. | |
| 2009/0225526 | A1 | 9/2009 | Behziz | |
| 2013/0161071 | A1 | 6/2013 | Kodama et al. | |
| 2014/0170897 | A1 * | 6/2014 | Nonen | H01R 13/5829 439/467 |
| 2015/0162670 | A1 * | 6/2015 | Galla | H01R 43/01 29/872 |

FOREIGN PATENT DOCUMENTS

| | | |
|---|---|---|
| CN | 103650256 A | 3/2014 |
| CN | 203589375 U | 5/2014 |
| DE | 69800778 | 8/2001 |
| DE | 10026294 | 12/2001 |
| EP | 1427060 | 6/2004 |
| EP | 2556564 | 1/2016 |
| JP | H0896919 | 4/1996 |
| JP | H11260440 | 9/1999 |
| JP | 2001035567 | 2/2001 |
| JP | 5206524 | 6/2013 |
| JP | 5224793 | 7/2013 |
| WO | 2012137547 | 11/2012 |
| WO | 2013006592 | 1/2013 |

OTHER PUBLICATIONS

International Search Report and Written Opinion of the International Searching Authority for PCT/EP2018/064897, European Patent Office, dated Aug. 6, 2018.
International Preliminary Report on Patentability for PCT/EP2018/064897, European Patent Office, dated Jul. 11, 2019.
China National Intellectual Property Administration, Patent Application No. 201880038775.4, Office Action dated Aug. 25, 2020.

* cited by examiner

POSITIONING ELEMENT AND CONTACTING ELEMENT FOR TWIN AXIAL CABLES

CROSS-REFERENCE TO RELATED APPLICATIONS

This application is the U.S. national phase of international application PCT/EP2018/064897, filed on Jun. 6, 2018, which claims the benefit of German application DE 10 2017 209 868.6 filed on Jun. 12, 2017; all of which are hereby incorporated herein in their entirety by reference.

The invention relates to a positioning element for twin axial cables and to a contacting element with such a positioning element.

Twin axial cables (Twinax cables) usually have a pair of inner conductors, an inner dielectric, a shield and/or a filler wire (outer conductor). Finally, an outer dielectric, which envelopes the aforesaid components, insulates the cable against environmental influences. A possible application area is, for example, the low-loss transmission of symmetrical signals in computer or communications technology.

If such twin axial cables are connected to a circuit board and/or fixed to this, for example, as well as the contacting of the inner conductor pairs, contacting of the outer conductor (s) is mostly also provided, usually to one or more earthing contacts of the circuit board.

For this purpose it has hitherto been necessary to strip the ends of the twin axial cables to be connected, to prepare them and to align them on the circuit board individually before an electrical connection can be created by soldering, for example. In particular, the filler wire, which is often very thin, can break in this process, due to which a complete arrangement of twin axial cables and circuit board to be produced may not be able to be processed further. Moreover, automatic stripping of the twin axial cables is problematic, as the exact position in the cable of the damage-prone filler wire is often not known exactly.

The connection, in particular soldered connection, that is also required for the outer conductor to the circuit board takes up additional space on the circuit board to be contacted, so that the maximum number of twin axial cables to be connected is reduced.

Another disadvantage is the lack of reproducibility of the contacts to be made individually of the twin axial cables to the circuit board.

For contacting of electrical conductors that are enclosed by insulation, insulation displacement connectors are known from the prior art.

The document DE 100 26 294 A1 thus shows the use of an insulation displacement connector as a cable connector. During assembly the insulation displacement connector guarantees that the outer insulation of a cable is slit open, thereby creating a connection to the cable core.

The document DE 698 00 778 T2 likewise shows an insulation displacement connector. The disclosed insulation displacement connector is suitable in particular for creating an electroconductive connection to a stranded conductor enclosed by insulation.

A requirement exists for an improved positioning element and an improved contacting element for twin axial cables. The object is therefore to provide an improved positioning element and an improved contacting element for twin axial cables.

According to a first aspect, a positioning element for twin axial cables is provided. The positioning element is at least partially electroconductive. The positioning element has at least one recess. The recess is arranged and designed to accommodate a twin axial cable. More precisely, the recess is arranged and designed so as to accommodate a twin axial cable in such a way that an electroconductive connection of an outer conductor of the twin axial cable exists to the positioning element.

By accommodating the twin axial cable in the at least one recess, an electroconductive connection of the outer conductor of the twin axial cable to the positioning element can be achieved/created.

According to one exemplary embodiment, the positioning element can have a plurality of recesses, which are each arranged and designed to accommodate one of a plurality of twin axial cables respectively in such a way that an electroconductive connection of an outer conductor of the respective twin axial cable exists to the positioning element.

Due to the accommodation of one of the plurality of twin axial cables in the respective recesses, an electroconductive connection of an outer conductor of the particular twin axial cable to the positioning element can be achieved/created. Simple accommodation for the efficient electrical contacting of twin axial cables is provided by this.

The twin axial cables to be connected can each have an inner conductor pair. The inner conductor pair can have two symmetrical inner conductors that are electrically insulated from one another, or it can be formed from these. Furthermore, the twin axial cables to be connected can each comprise an inner dielectric, which surrounds and electrically insulates the inner conductors. The twin axial cables to be connected can have a shield, which can act in particular as an earthing conductor. An outer dielectric can insulate each of the twin axial cables electrically and protect them from environmental influences. The shield can be located between the inner and the outer dielectric. In specific configurations the twin axial cables to be connected can have a filler wire instead of the shield or in addition to the shield, which wire can likewise act in particular as an earthing conductor. Both the shield and the filler wire can be described below in summary as outer conductors. The outer conductor lies further out in a radial direction of the twin axial cable than the inner conductors.

The positioning element can have a comb shape/be designed in the form of a comb. For example, a plate-shaped positioning element that has a plurality of recesses open towards a lateral edge of the positioning element can be understood as comb-shaped. A positioning element of this kind can have a small thickness or depth in relation to its height and its width. The positioning element can be designed as a comb-shaped sheet, for example. However, this is not necessary for all embodiments. In one alternative embodiment the positioning element can have a comb shape only in a cross section and at the same time have an extended depth, wherein depth in this case describes the spatial direction orthogonal to the comb-shaped cross section.

The geometrical forms of the recess or of the plurality of recesses of the positioning element correspond in particular to the cross-sectional geometries of the twin axial cables to be connected in each case.

The positioning element can be designed to accommodate at least one twin axial cable such that at least a part of the positioning element penetrates at least a part of the twin axial cable in such a way that an electroconductive connection is created between the positioning element and the outer conductor of the at least one twin axial cable. This means that in a state in which the twin axial cable is accommodated in the positioning element, an electroconductive connection can be created between the positioning element and the outer conductor of the at least one twin axial cable.

The positioning element can be designed to accommodate a plurality of twin axial cables such that at least one part of the positioning element penetrates at least one part of the respective twin axial cable in such a way that an electroconductive connection is created between the positioning element and the respective outer conductors of the plurality of twin axial cables.

For example, a part of the positioning element in the area of at least one recess can be designed to be sharp-edged. For example, the positioning element can have toothing in the area of at least one recess. Due to the positioning of a twin axial cable in at least one recess, one of the parts of the positioning element designed to be sharp-edged can penetrate at least a part of the dielectric of the twin axial cable (infiltrate into at least a part of the dielectric of the twin axial cable) and create an electroconductive connection to the shield and/or to the filler wire of a twin axial cable in this way. The electroconductive connection thus created can be water-tight and/or gas-tight in particular.

One advantage of the penetration/infiltration of a twin axial cable by a part of a positioning element designed to be sharp-edged consists in the fact that an electroconductive connection can be created to a shield and/or a filler wire of the twin axial cable without the outer dielectric having to be stripped. In order to create an electroconductive connection of the outer conductor of the twin axial cable to the positioning element, for example for the purpose of earthing the twin axial cable, it is sufficient to press the twin axial cable into a recess of the positioning element.

Since the stripping of twin axial cables, in particular of twin axial cables that have a filler wire, is prone to error and can only be automated with difficulty and/or expensively, a possible automation capability of an overall process is advanced by omitting this production step.

Another advantage consists in the fact that at least the exact position of a filler wire does not have to be known to create an electroconductive connection to a positioning element. It suffices to ensure that the filler wire is located in that area of the twin axial cable that is penetrated by the part of the positioning element designed to be sharp-edged/into which the part of the positioning element designed to be sharp-edged infiltrates.

The positioning element can be designed to accommodate a twin axial cable or a plurality of twin axial cables in such a way that the twin axial cable(s) is/are forced into a predetermined spatial arrangement by the take-up in the positioning element.

Furthermore, the positioning element can be designed/manufactured in one piece. For example, the positioning element can be formed/manufactured from a metal, for example from a copper or iron alloy or from a metal sheet.

According to a second aspect, a contacting element for twin axial cables is provided. The contacting element comprises a positioning element according to the first aspect and a terminal element. The terminal element is connectable to at least one twin axial cable. The twin axial cable has an outer conductor. The positioning element is connected to the terminal element. The contacting element therefore comprises an at least partially electroconductive positioning element and a terminal element. The terminal element is arranged and designed to be connectable to at least one twin axial cable. The twin axial cable has an outer conductor. The positioning element is connected to the terminal element. The positioning element has at least one recess, which is arranged and designed to accommodate a twin axial cable such that an electroconductive connection of the outer conductor of the twin axial cable to be accommodated (or—in the accommodated state—of the accommodated twin axial cable) exists to the positioning element.

The terminal element can be connectable to a plurality of twin axial cables, which each have an outer conductor. The positioning element can have a plurality of recesses, which are each arranged and designed to accommodate one twin axial cable respectively from the plurality of twin axial cables in such a way that an electroconductive connection of the outer conductor of the respective twin axial cable to be accommodated (or—in the accommodated state—of the accommodated twin axial cable) exists to the positioning element.

An arrangement and contacting of a twin axial cable or of a plurality of twin axial cables to a terminal element, for example on a circuit board, is simplified hereby.

The terminal element is connectable to a twin axial cable or to a plurality of twin axial cables, for example, due to the fact that the inner conductors of the respective inner conductor pairs of the twin axial cables are connectable electroconductively to connection points of the terminal element. For example, the inner conductors of the respective inner conductor pairs can be connected electroconductively to the connection points by a soldering process.

In one exemplary embodiment the positioning element can be in a state of connection/be connected to the terminal element such that the recesses of the positioning element are arranged spatially relative to the connection points of the terminal element in such a way that by arranging a twin axial cable in a recess of the positioning element, a predetermined orientation of the twin axial cable is enforced at the same time. The orientation of the twin axial cable can be enforced in a manner such that the inner conductors of the twin axial cable are connectable to the connection points of the terminal element. In particular, the recesses of the positioning element can open towards the terminal element.

One advantage in this case is that by arranging the respective twin axial cables in the recesses of the positioning element, a suitable arrangement of the twin axial cables for contact with the terminal element is achieved at the same time. An automation capability of the overall process is thus advanced further.

The terminal element can have two connection points in each case for respectively one/each of the twin axial cables to be connected. For example, the connection points can be prepared copper contacts or solder points.

Furthermore, the terminal element can have at least one earthing contact, which is connected electroconductively to the (at least partially electroconductive) positioning element. In one variant the terminal element can have a number of earthing contacts, which are each connected electroconductively to the positioning element.

In one embodiment of the contacting element, the positioning element can be connected to the terminal element at an angle. The angle can be between 60° and 120° and can for example be 90°. The positioning element can be connected to a part of the terminal element, in particular to the earthing contact, electroconductively such that an electroconductive connection exists between the part of the terminal element, in particular the earthing contact, and the respective outer conductor of one or of a plurality twin axial cables accommodated in the positioning element.

One advantage in this case is that for contacting of the outer conductors (of the respective twin axial cables) with the terminal element, in particular with an earthing contact of the terminal element, no additional connection, in particular soldered connection, is required. The number of connections required overall, in particular soldered connections, can be reduced by this. This makes it possible, for example, to increase the number of twin axial cables that can be connected in total to the circuit board.

If the outer conductors of a plurality of twin axial cables are connected jointly by a positioning element to the same earthing contact of a terminal element, possible crosstalk is effectively counteracted by maximisation of the electric near-end crosstalk attenuation. This effect is achieved independently of whether the twin axial cables to be connected to the terminal element have a filler wire and/or a shield.

Another advantage is that the reproducibility of manufacturing is increased by the reduction in connections to be performed manually. The overall production process can be automated further due to this.

The terminal element can be a circuit board, in particular a printed circuit board (PCB).

Other features, attributes, advantages and possible modifications become clear to a person skilled in the art by means of the following description, in which reference is made to the enclosed drawings. Here the figures show schematically and by way of example a contacting element for twin axial cables. All the described and/or illustrated features show the subject matter disclosed here by themselves or in any combination. The dimensions and proportions of the components shown in the figures are not to scale.

Components and features that are comparable or identical and with the same effect are provided in the figures with the same reference signs in each case. In some cases reference signs of individual features and components have also been omitted in the figures for reasons of clarity, wherein these features and components are provided with reference signs in other figures.

Figure 1A:
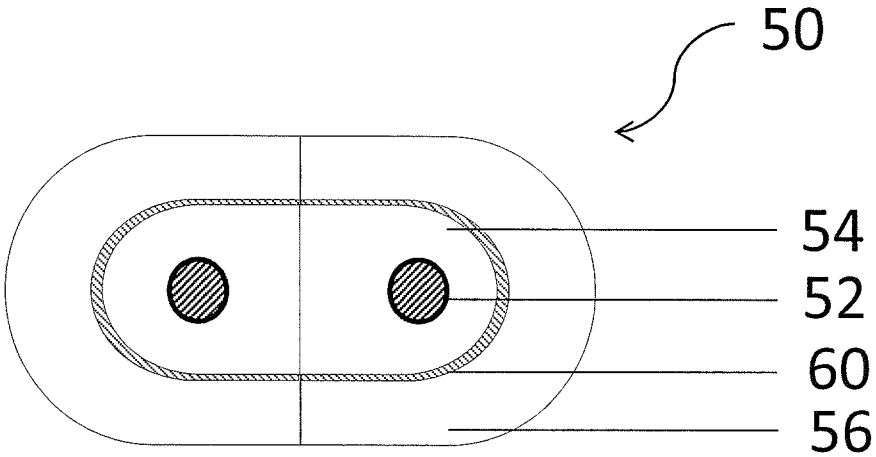
FIG. 1A-1B show examples of twin axial cables schematically in cross section.

FIG. 1A shows schematically an example of the structure of a twin axial cable 50 in cross section. The twin axial cable 50 has two symmetrically arranged signal-carrying inner conductors 52, which are surrounded by an inner dielectric 54. Here the inner dielectric 54 electrically insulates the inner conductors 52, which are manufactured from copper, for example. A shield 60 encloses the inner dielectric 54 in the example of the twin axial cable 50 shown in FIG. 1A. The shield 60 acts as a protective conductor of the twin axial cable 50 in the example shown. An outer dielectric 56 protects the twin axial cable 50 against environmental influences and insulates the shield 60 electrically.

Figure 1B:
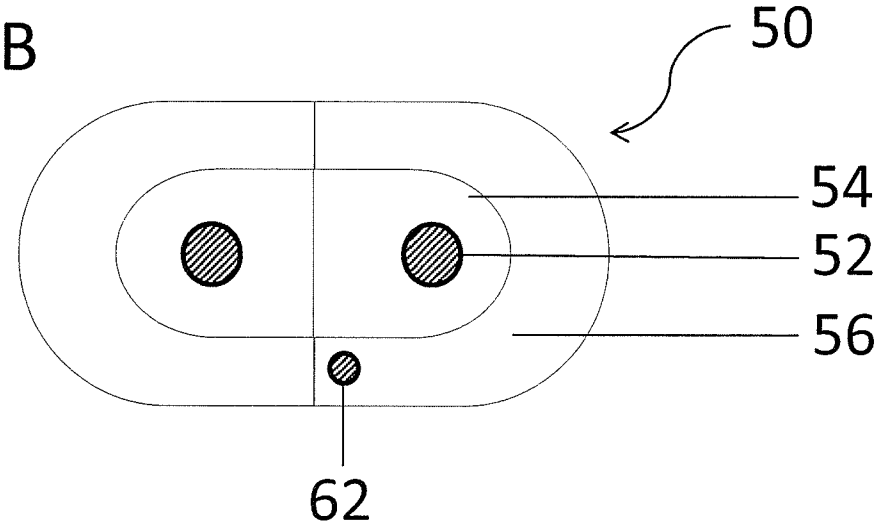

FIG. 1B shows schematically an example of the structure of a twin axial cable 50, wherein the twin axial cable 50 has a filler wire 62. The filler wire 62 acts in the example shown in FIG. 1B as a protective conductor of the twin axial cable 50. Furthermore, FIG. 1B shows by analogy with FIG. 1A two symmetrically arranged signal-carrying inner conductors 52, an inner dielectric 54 and an outer dielectric 56. The filler wire 62 is completely enclosed by the outer dielectric 56.

The examples of twin axial cables 50 shown in FIGS. 1A and 1B have purely an exemplary character. Other configurations of twin axial cables have circular or elliptical cross sections, for example. The filler wire 62 shown in FIG. 1B can be located between the inner 54 and the outer dielectric 56 in other examples. Configurations of twin axial cables with a shield and a filler wire, which mutually complement one another in their function, are also known as the prior art. The examples shown in FIGS. 1A and 1B thus serve purely for clarification, but expressly do not restrict the use of the contacting element described below to an interaction with the examples of twin axial cables depicted.

Figure 2A:
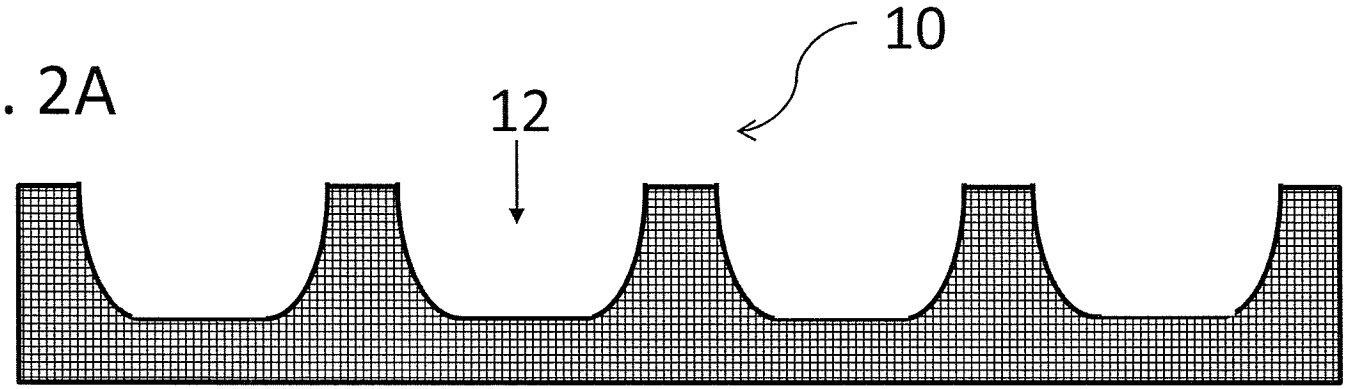
FIG. 2A-2B show exemplary embodiments of a positioning element for twin axial cables schematically in two side views rotated by 90° to one another.
Figure 2B:
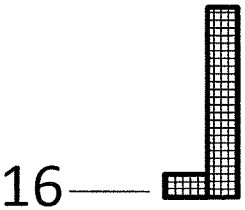

FIGS. 2A and 2B show schematically a side view of a positioning element 10. The positioning element 10 shown has, by way of example and without being restricted hereto, four recesses 12, which correspond in their form to the cross sections of the coaxial cables to be accommodated. The exemplary embodiment of a positioning element 10 shown in FIG. 2A has four recesses 12 purely as an example and is thus suitable for the arrangement of up to four twin axial cables 50.

Let it be pointed out that FIGS. 2A and 2B show only one example, and that other exemplary embodiments (not shown) can in particular have any number of recesses 12, which can correspond in their form respectively to the cross sections of the twin axial cables to be accommodated.

The recesses 12 of the positioning element 10 shown schematically in FIG. 2A are further formed sharp-edged and are suitable for penetrating at least a part of the outer dielectric 56 and/or a part of the inner dielectric 54 of a twin axial cable 50 to be accommodated.

The positioning element 10 shown in FIGS. 2A and 2B is manufactured in one piece from an electroconductive steel sheet.

FIG. 2B shows the positioning element 10 from a side view, which is rotated by 90° compared with the view in FIG. 2A. It is to be recognised that the positioning element 10 in this view has an L-shaped cross section. Furthermore, the positioning element is flat in this side view (in comparison to its lateral extension). A plinth section 16 of the positioning element 10 can be used in particular for attachment to a terminal element 20. Other embodiments (not shown) can have T-shaped or Y-shaped lateral cross sections, for example.

Figure 3A:
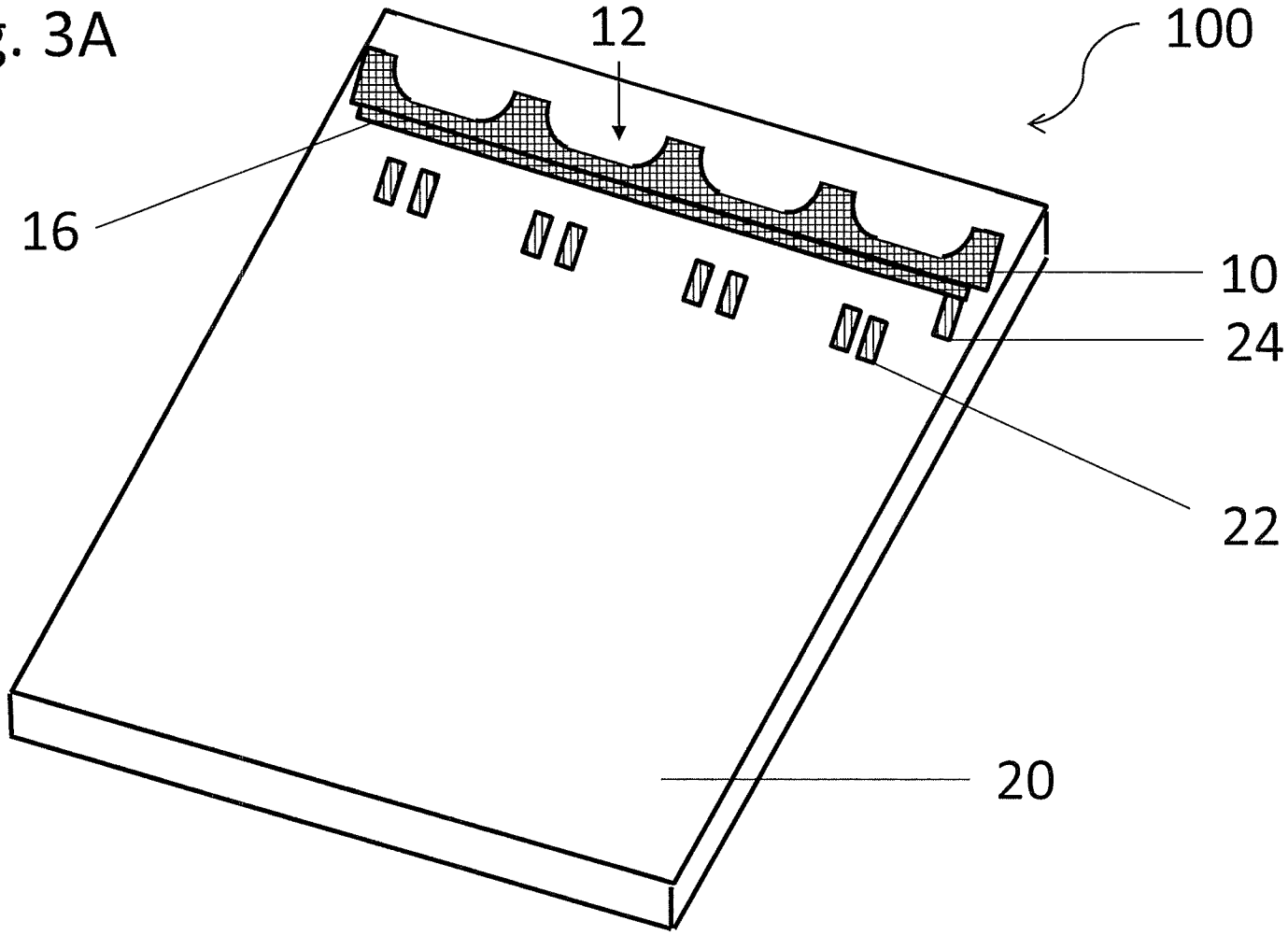
FIG. 3A-3C show an exemplary embodiment of a contacting element for twin axial cables schematically with a positioning element and a terminal element.

FIG. 3A shows an exemplary embodiment for a contacting element 100 schematically from a perspective view, wherein the depiction of the contacting element 100 is reduced to the components relevant for comprehension. The contacting element 100 has a terminal element 20 and a positioning element 10. In particular, the terminal element 20 can comprise, for example, electronic device elements such as transistors, resistors, conductor paths, logic circuits and/or components with inductive or capacitive properties, for example. In one embodiment the terminal element 20 can be in particular a circuit board with a printed circuit (PCB).

FIG. 3A shows a positioning element 10, which is arranged at a 90° angle on a terminal element 20 and is connected electroconductively to an earthing contact 24. The positioning element 10, which is manufactured in one piece from a steel sheet, thus lies completely on the electric potential of the earthing contact 24 of the terminal element 20. The electroconductive connection between the earthing contact 24 and the positioning element 10 can be created in particular by a soldering process.

FIG. 3A also shows correspondingly arranged connection points 22 for each of the recesses 12 of the positioning element 10. Two connection points 22 of the terminal element 20 are associated in each case with a recess 12 of the positioning element 10. The connection points 22 are arranged and designed to be connected electroconductively to the respective inner conductors 52 of the twin axial cables 50 to be accommodated. In particular, an electroconductive connection can be created by a soldering process.

Figure 3B:
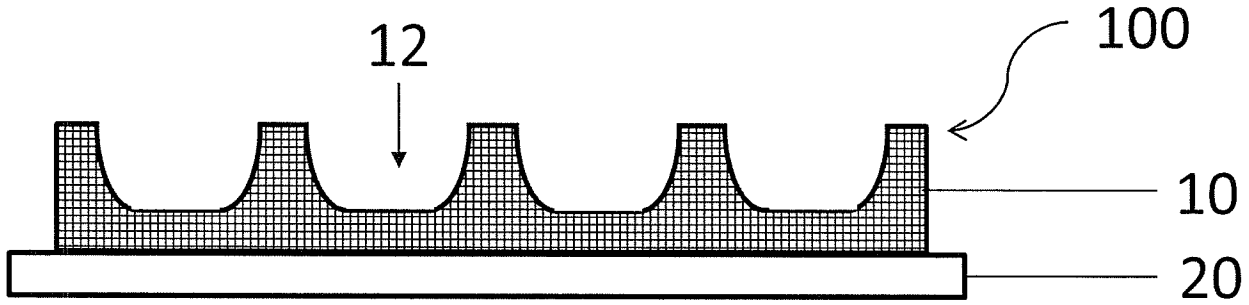
Figure 3C:
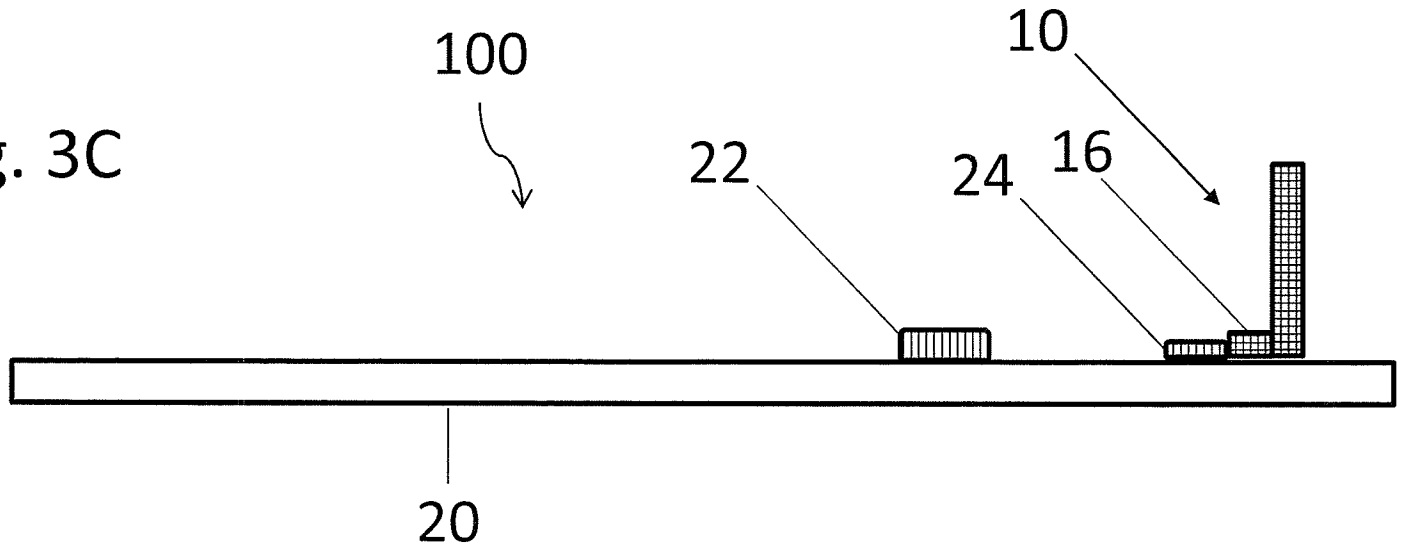

FIGS. 3B and 3C show schematically two side views of the contacting element 100 rotated by 90° to one another. By analogy with FIG. 3A, FIGS. 3B and 3C show the terminal element 20, the positioning element 10 connected to the terminal element 20 with the recesses 12, the connection points 22 and the earthing contact 24.

Figure 4:
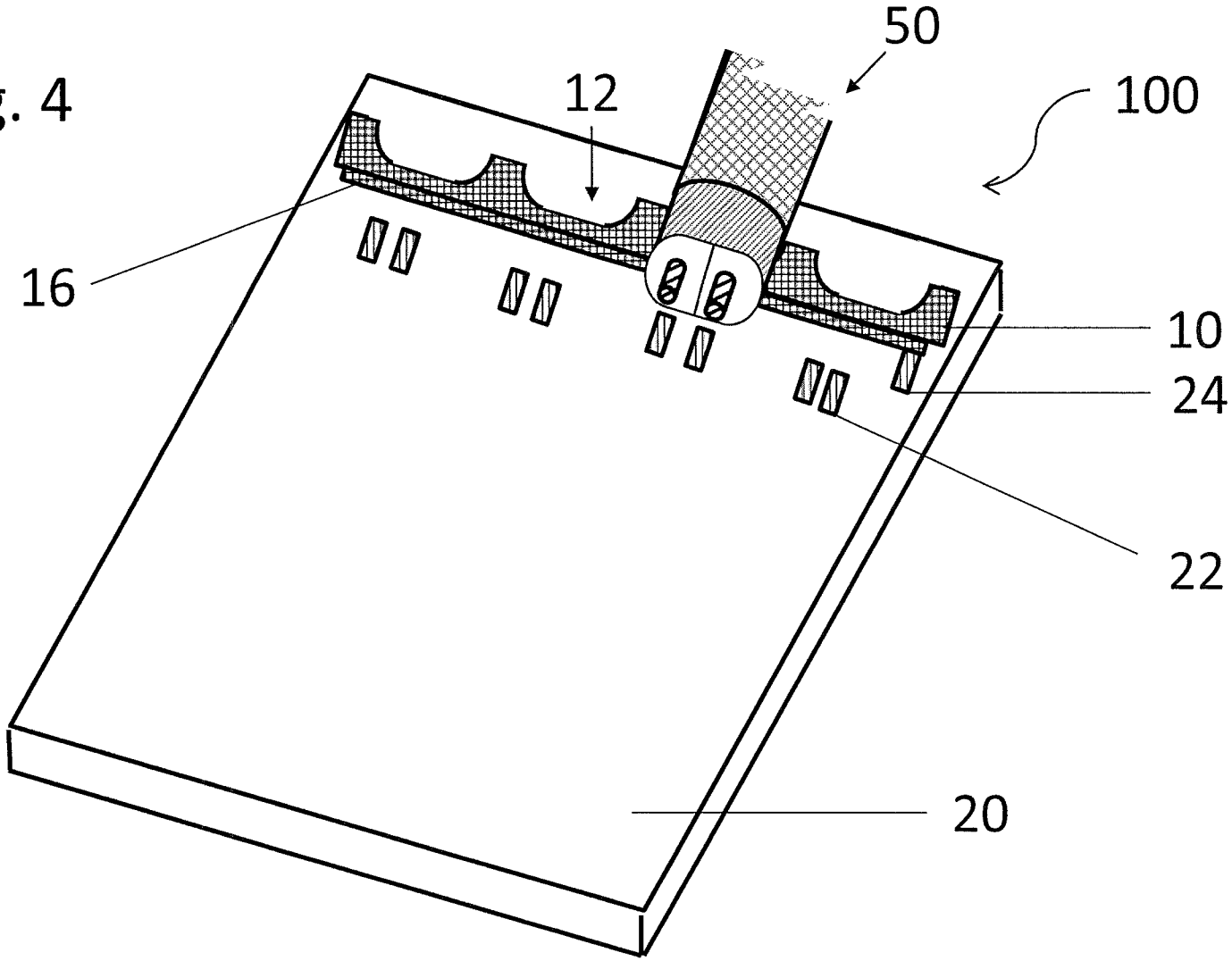
FIG. 4 shows the exemplary embodiment of a contacting element from FIGS. 3A-3C schematically with a partly stripped twin axial cable arranged therein.

FIG. 4 shows by way of example a twin axial cable 50 arranged on a contacting element 100, wherein the twin axial cable 50 is accommodated by the positioning element 10 such that an electroconductive connection exists between the shield 60 of the twin axial cable 50 and the positioning element 10.

In the exemplary embodiment shown in FIG. 4, the outer dielectric 56 of the twin axial cable 50 is partially stripped at the connection point, so that a simple insertion of the twin axial cable 50 into the positioning element 10 creates an electroconductive connection between the positioning element 10 and the shield 60.

Due to the electroconductive connection of the positioning element 10 to the earthing contact 24, the shield 60 is also connected electroconductively to the earthing contact 24 in the arrangement shown.

FIG. 4 shows an exemplary embodiment with a twin axial cable 50 according to FIG. 1A. It is understood that a twin axial cable 50 according to FIG. 1B is also connectable in the manner shown to the positioning element 10 and thus to the contacting element 100 if the filler wire 62 of the twin axial cable 50 is stripped or exposed at least in the area of the positioning element 10.

In other embodiments (not shown) additional elements, for example cable fixing clips, can additionally fix the twin axial cable 50 on the contacting element 100.

The twin axial cable 50 shown denotes by way of example and representatively a plurality of twin axial cables 50, which are connectable to the positioning element 10 and thus to the contacting element 100. The maximum number of twin axial cables 50 to be connected is limited by the number of recesses 12 of the positioning element 10 and/or by the number of connection points 22. This means that the number of twin axial cables 50 can be coordinated to the number of recesses 12, i.e. the number of twin axial cables 50 can correspond to the number of recesses 12.

Furthermore, in the variant of the contacting element 100 shown in FIG. 4, all twin axial cables 50 to be connected are connected to the earthing contact 24. In other embodiments (not shown) the positioning element 10 can consist of two parts, for example, which are electrically insulated from each other by a dielectric, so that an electrical connection of outer conductors of different twin axial cables to different earthing contacts, for example, is possible. In these embodiments different electroconductive parts of the positioning element 10 can have different electrical potentials.

In other embodiments (not shown) the positioning element 10 can interact with the terminal element 20 and/or other elements, in particular cable fixing clips, such that a predetermined spatial arrangement of the twin axial cables 50 to be accommodated is enforced. In particular, a substantially parallel orientation of the twin axial cables 50 to be accommodated can be achieved by a suitable arrangement of the recesses 12 of the positioning element 10.

FIG. 4 also shows that the inner 54 and outer dielectric 56 of the twin axial cable 50 are stripped at the connection point such that the inner conductors 52 are exposed and are connectable to the connection points 22 of the terminal element 20. In particular, an electroconductive connection can be created by a soldering process.

Figure 5A:
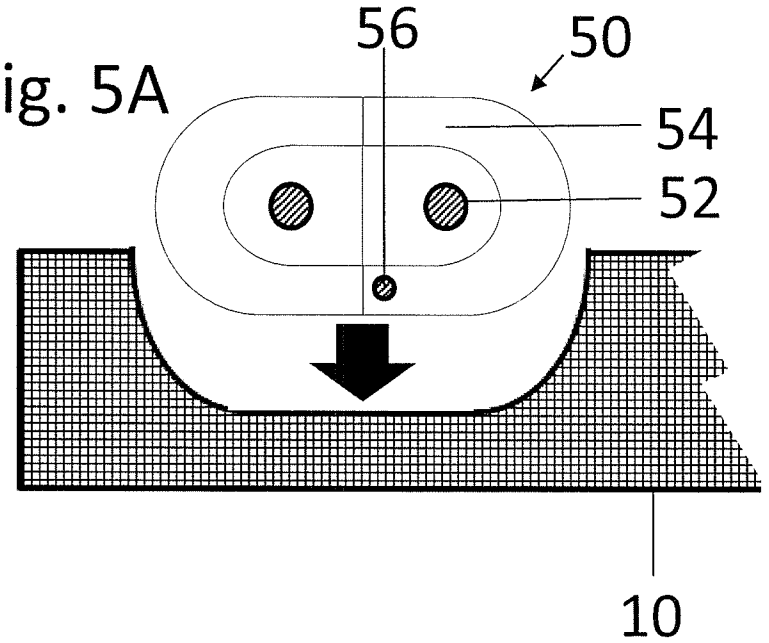
FIG. 5A-5D show schematically the partial penetration of twin axial cables by sharp-edged parts of a positioning element.
Figure 5B:
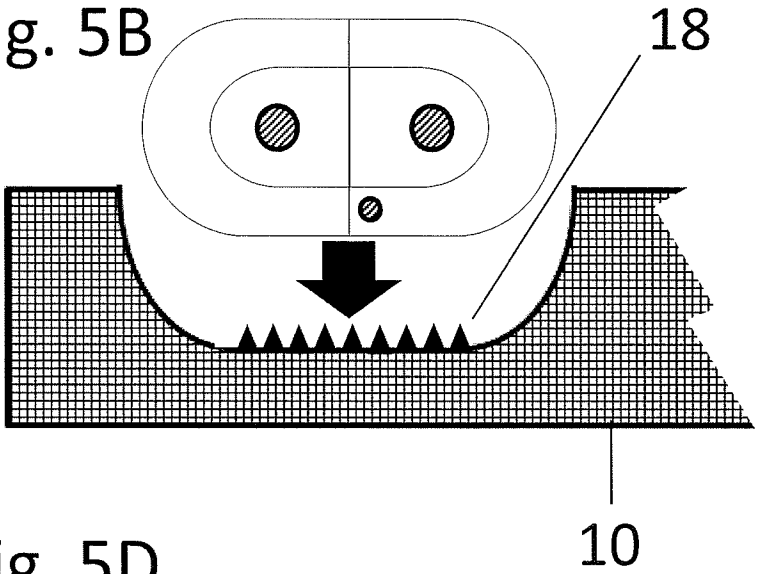

FIGS. 5A and 5B clarify the advantages of a sharp-edged design of the recesses 12 of the positioning element 10. If the recesses 12 are designed to be sharp-edged, it is not necessary to strip the outer dielectric 56 prior to arrangement of the twin axial cable 50 in the recess 12 in order to create an electroconductive connection between the positioning element 10 and the filler wire 62 or the shield 60 (shield 60 not shown). It is sufficient to press the twin axial cable 50 into the recess 12 of the positioning element 10 so that the sharp-edged rim of the recess 12 at least partially penetrates at least the outer dielectric 56 and thus establishes an electroconductive connection to the filler wire 62 or to the shield 60.

Figure 5C:
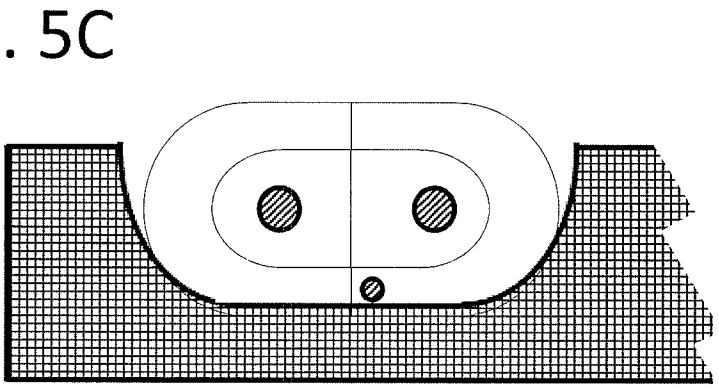
Figure 5D:
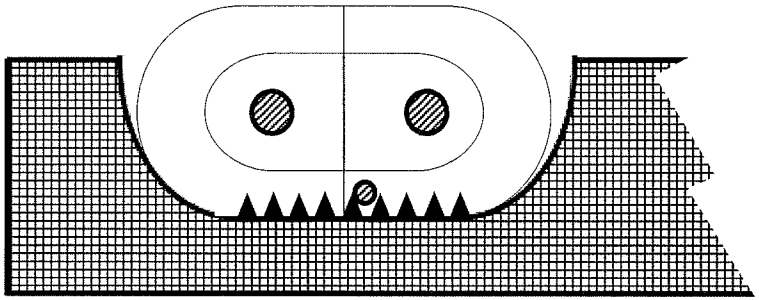

In an embodiment shown in the figures in FIGS. 5C and 5D, the positioning element 10 can have sharp-edged toothing 18 in the area of the recess 12. This can make penetration of the dielectric easier, improve the creation of an electroconductive connection to the filler wire 62 and support fixing of the twin axial cable 50 on the contacting element 100.

While twin axial cables 50 that have a shield 60 can be positioned in any way in the recess 12, twin axial cables 50 that only have a filler wire 62 must be positioned in the recess 12 at least in a suitable spatial orientation. However, the knowledge of an exact position of the filler wire 62 of a twin axial cable 50, which can vary contingent on production, is not necessary.

In a further development, the sharp-edged toothing 18 can also be located on the opposing lateral edges of the recess 12 and promote the fixing of the twin axial cable 50 and/or the creation of an electroconductive connection to the shield 60 or to the filler wire 62 in such a way.

Figure 6:
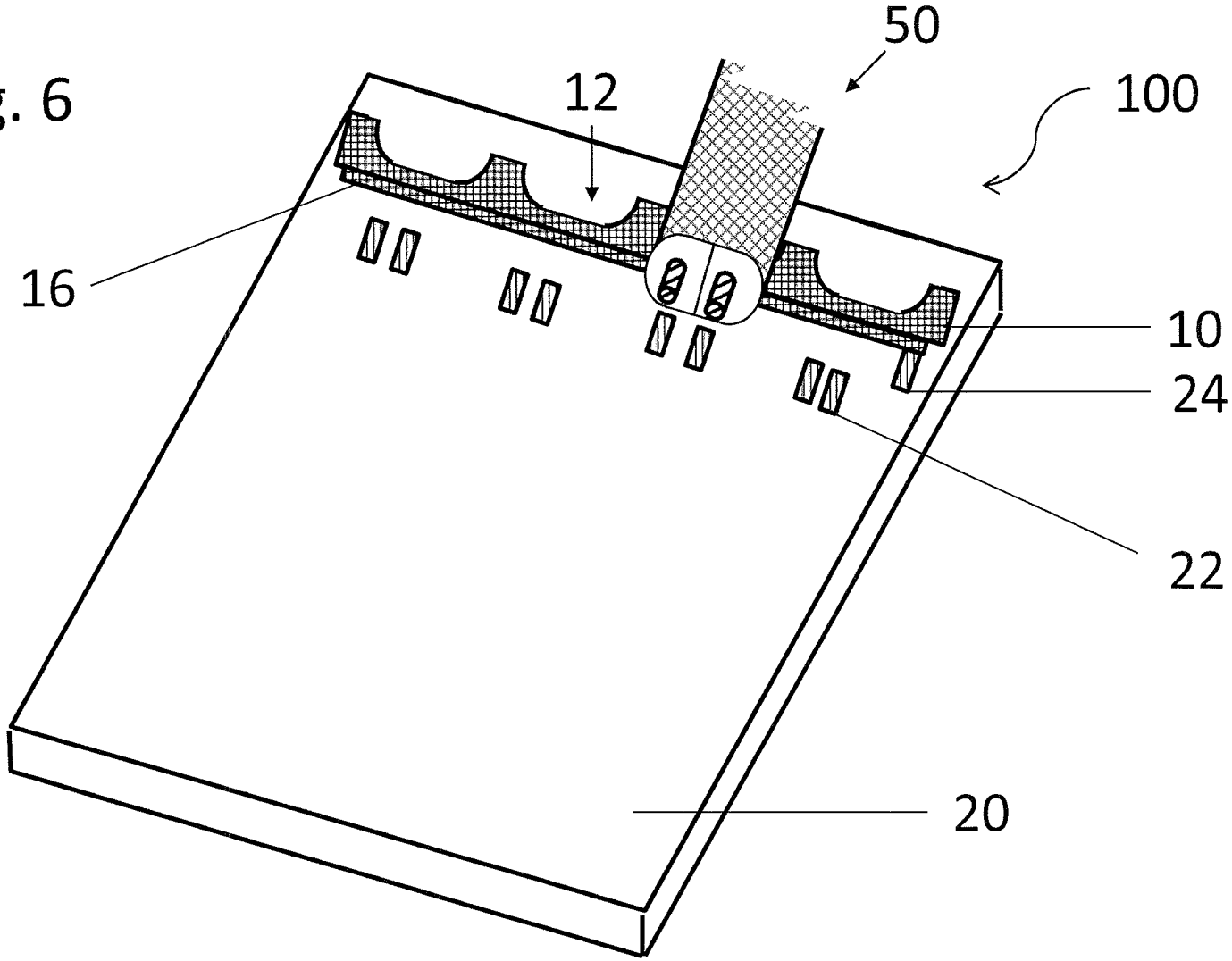
FIG. 6 shows the exemplary embodiment of a contacting element from FIG. 4 schematically with a partially penetrated twin axial cable arranged therein.

FIG. 6 shows an exemplary embodiment of the contacting element 100 analogous to FIG. 4, wherein the recesses 12 in FIG. 6 are designed to be expressly sharp-edged. Stripping of the twin axial cable 50 in the area of the positioning element 10 is thus not necessary. To create an electroconductive connection between the filler wire 62 or the shield 60 and the earthing contact 24, it is sufficient in the case of the exemplary embodiment depicted schematically in FIG. 6 to arrange the twin axial cable 50 in the recess 12 of the positioning element 10 such that a part of the positioning element 10 penetrates at least a part of the outer dielectric 56 and thus creates an electroconductive connection to the filler wire 62 or to the shield 60.

It is understood that the exemplary embodiments explained above are not conclusive and do not restrict the subject matter disclosed here. In particular, it is evident to the person skilled in the art that he can combine the features described with one another in any way and/or can omit various features without departing from the subject matter disclosed here.

The invention claimed is:

1. A positioning element for twin axial cables comprising an inner conductor pair and a filler wire, wherein the positioning element is designed to be comb-shaped and is at least partially electroconductive, and the positioning element has at least one recess with a sharp-edged plurality of teeth, which recess is designed corresponding in its form to the cross section of a twin axial cable to be accommodated and is arranged and designed to accommodate a twin axial cable pressed into the recess in such a way that the sharp-edged plurality of teeth penetrates a part of the twin axial cable so that an electroconductive connection of the filler wire of the twin axial cable is created to the positioning element.

2. The positioning element according to claim 1, wherein the positioning element has a plurality of recesses, which are each arranged and designed to accommodate one of a plurality of twin axial cables respectively in such a way that an electroconductive connection of the filler wire of the respective twin axial cable exists to the positioning element.

3. The positioning element according to claim 1, wherein the positioning element is designed to accommodate at least one twin axial cable such that the at least one twin axial cable is forced into a predetermined spatial arrangement by the take-up in the positioning element.

4. The positioning element according to of claim 1, wherein the positioning element is formed in one piece and/or from a copper or iron alloy or from a metal sheet.

5. A contacting element for twin axial cables, comprising:

a positioning element according to claim 1, and a terminal element, which is connectable to at least one twin axial cable, which has a filler wire, wherein the positioning element is connected to the terminal element.

6. The contacting element according to claim 5, wherein the terminal element is connectable to a plurality of twin axial cables, which each have a filler wire.

7. The contacting element according to claim 5, wherein the terminal element also has two connection points in each case for each twin axial cable to be connected.

8. The contacting element according to claim 5, wherein the terminal element also has an earthing contact, which is connected electroconductively to the positioning element.

9. The contacting element according to claim 5, wherein the terminal element is a printed circuit board.

10. The contacting element according to claim 5, wherein the positioning element is connected to the terminal element at an angle of ninety degrees.

11. The contacting element according to claim 5, wherein the positioning element is connected electroconductively to a part of the terminal element, in particular to the earthing contact, in such a way that an electroconductive connection exists between the part of the terminal element, in particular the earthing contact, and the filler wire of at least one twin axial cable.

* * * * *